US005947681A

United States Patent [19]

Rochford

[11] Patent Number: 5,947,681

[45] Date of Patent: Sep. 7, 1999

[54] PRESSURE BALANCED DUAL AXLE VARIABLE NOZZLE TURBOCHARGER

[75] Inventor: Keith Garrett Rochford, Fullerton, Calif.

[73] Assignee: AlliedSignal Inc., Morristown, N.J.

[21] Appl. No.: 09/033,274

[22] Filed: Mar. 2, 1998

Related U.S. Application Data

[60] Provisional application No. 60/041,256, Mar. 17, 1997.

[51] Int. Cl.[6] ..... F01B 25/02; F01D 11/00

[52] U.S. Cl. ..... 415/164; 415/160; 415/168.1; 415/150

[58] Field of Search ..... 415/150, 159, 415/160, 163, 164, 165, 166, 162, 168.1, 168.2, 169.1

[56] References Cited

U.S. PATENT DOCUMENTS

| | | | |
|---|---|---|---|
| 1,823,702 | 9/1931 | Ring | 415/168.2 |
| 1,860,618 | 5/1932 | Nagler | 415/169.1 X |
| 1,942,589 | 1/1934 | Biggs | 415/163 X |
| 4,436,481 | 3/1984 | Linder | 415/163 X |
| 4,490,622 | 12/1984 | Osborn . | |
| 4,521,555 | 6/1985 | Osborn . | |
| 4,602,410 | 7/1986 | Karlsson et al. . | |
| 4,643,640 | 2/1987 | Burdette et al. . | |
| 4,654,941 | 4/1987 | Burdette et al. . | |
| 4,659,295 | 4/1987 | Burdette et al. . | |
| 4,679,984 | 7/1987 | Swihart et al. | 415/163 |
| 4,741,666 | 5/1988 | Shimizu et al. . | |
| 4,770,603 | 9/1988 | Engels et al. | 415/164 X |
| 4,804,316 | 2/1989 | Fleury . | |
| 5,028,208 | 7/1991 | Mitsubori et al. . | |
| 5,146,752 | 9/1992 | Bruestle | 415/164 X |
| 5,564,895 | 10/1996 | Agahi et al. | 415/164 X |

OTHER PUBLICATIONS

JP 61185622 A, Aug. 19, 1986, Patent Abstracts of Japan; vol. 011, No. 010 (M552); Toyota Motor Corp.

*Primary Examiner*—John E. Ryznic
*Attorney, Agent, or Firm*—Felix L. Fischer

[57] ABSTRACT

A turbocharger with a variable turbine nozzle having a plurality of vanes provides reduced actuation forces by pressure balancing the vane support axles. A nozzle ring and insert ring are secured in substantially rigid spaced relation by a series of hollow spacers and bolts to position the vanes between the nozzle inlet from the volute and nozzle outlet adjacent the turbine. A chamber intermediate the turbine housing and the center housing of the turbocharger accommodates the actuation mechanism for the nozzle vanes and through communication with the nozzle inlet from the volute by the tolerances between the nozzle ring and various elements of the actuation linkage transmits exhaust gas pressure to impinge on an end of the first axle for each vane. Balancing exhaust gas pressure is transmitted through channels between the turbine housing and insert ring, which extend from the nozzle inlet to the apertures receiving the second axles, to impinge on an end of the second axle for each vane. A unison ring receiving vane arms extending perpendicular from the first axles is employed for rotating the vanes.

10 Claims, 5 Drawing Sheets

PRESSURE BALANCED DUAL AXLE VARIABLE NOZZLE TURBOCHARGER

CROSS REFERENCE TO RELATED APPLICATIONS

This application claims the benefit of the filing date of provisional application 60/041,256 having a filing date of Mar. 17, 1997 entitled Pressure Balanced Dual Axle Variable Nozzle Turbocharger,

BACKGROUND OF THE INVENTION

1. Field of the Invention

The present invention relates generally to variable nozzle turbochargers. More particularly, the invention provides a double axle mounting for the variable vanes of a turbocharger and further includes pressure balancing of the axles for minimizing axial forces tending to act on the vane assembly.

2. Description of the Related Art

In a turbocharger it is often desirable to control the flow of exhaust gas into the turbine to improve the efficiency or operational range. Various configurations of variable nozzles have been employed to control the exhaust gas flow. Multiple pivoting vanes annularly positioned around the turbine inlet and commonly controlled to alter the throat area of the passages between the vanes is an approach which has been successfully used in prior turbochargers. Various approaches to this method for implementing a variable nozzle are disclosed in U.S. Pat. No. 4,679,984 to Swihart et al. entitled "Actuation System for Variable Nozzle Turbine" and U.S. Pat. No. 4,804,316 to Fleury entitled "Suspension for the Pivoting Vane Actuation Mechanism of a Variable Nozzle Turbocharger" having a common assignee with the present application.

Use of cantilevered vanes mounted on an axle such as that disclosed in the '316 patent have been successfully employed in various turbochargers for truck and automotive applications. Under certain operating conditions resulting in a combination of reduced nozzle flow area and elevated turbine inlet pressure, the turbine of the turbocharger effectively operates as an impulse turbine wherein the majority of the drop in stage pressure occurs in the nozzle with the turbine rotor operating at substantially atmospheric static pressure. The large differential pressure acting across the nozzle vanes of the conventional pivoting, cantilevered nozzle vanes creates a reactive couple, which, because of the finite span of the vane axle, results in high reactive side forces and friction. Simultaneously, leakage of exhaust gas from the entry into the nozzle through the operating linkage and nozzle ring supporting the vanes creates an axial force component on the vane mounting axles which forces the ends of the nozzle vanes into the turbine casing shroud wall, creating additional friction. The length of the vane exacerbates the created frictional torque by the long moment arm relative to the axle shaft radius. Movement and control of the vane position is only possible by the application of highly non-linear actuation forces and control hysteresis, due to a combination of friction and "stiction", is excessive.

It is therefore desirable to provide a variable nozzle turbocharger design employing multiple pivoting vanes which reduces the reactive couple on the vane support and further eliminates axial loading of the vane support axles.

SUMMARY OF THE INVENTION

The present invention provides the desirable features over the prior art for a variable nozzle for the turbine of a turbocharger. A turbine housing is provided with a volute receiving exhaust gas from an internal combustion engine and a nozzle inlet. The turbine received in the turbine housing is driven by the exhaust gas from a nozzle outlet. The nozzle includes a plurality of vanes each having a first axle extending from one side of the vane and a second axle extending from an opposite side of the vane coaxial with the first axle. A nozzle ring has a plurality of apertures closely receiving the first axles of the plurality of vanes while an insert ring has a plurality of apertures and closely receiving the second axles of the plurality of vanes, the nozzle ring and insert ring forming the hub and shroud of the nozzle.

The nozzle ring and insert ring are secured in substantially rigid spaced relation by a series of hollow spacers and bolts to position the vanes between the nozzle inlet from the volute and nozzle outlet adjacent the turbine. A chamber intermediate the turbine housing and the center housing of the turbocharger accommodates the actuation mechanism for the nozzle vanes and through communication with the nozzle inlet from the volute by the tolerances between the nozzle ring and various elements of the actuation linkage transmits exhaust gas pressure to impinge on an end of the first axle for each vane. Balancing exhaust gas pressure is transmitted through channels between the turbine housing and insert ring, which extend from the nozzle inlet to the apertures receiving the second axles, to impinge on an end of the second axle for each vane. A unison ring receiving vane arms extending perpendicular from the first axles is employed for rotating the vanes.

BRIEF DESCRIPTION OF THE DRAWINGS

The details and features of the present invention will be more clearly understood with respect to the detailed description and drawings in which.

DETAILED DESCRIPTION OF THE INVENTION

Figure 1:
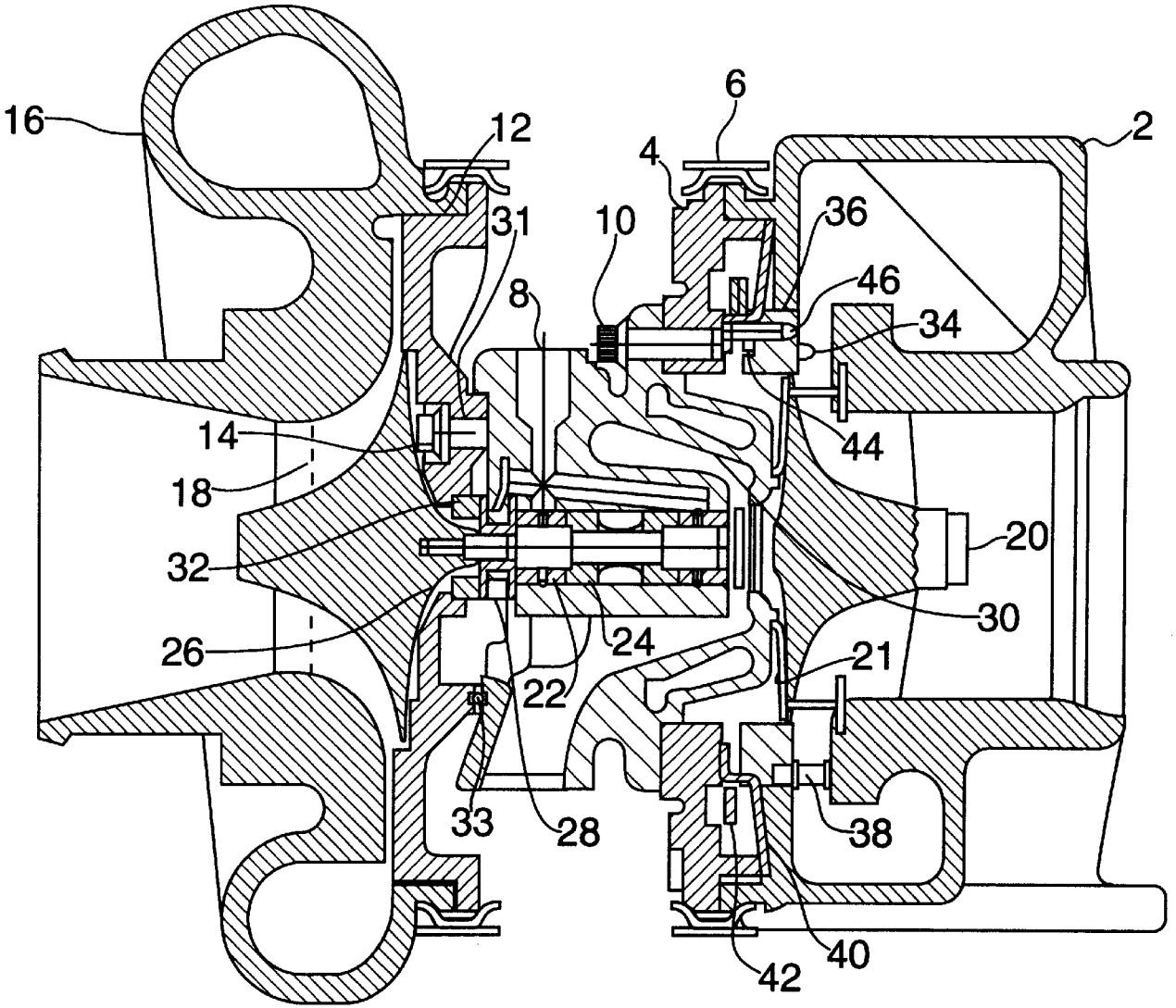
FIG. 1 is a section side view of a prior art variable nozzle turbine employing multiple pivoting vanes.

Referring to the drawings, FIG. 1 shows a variable nozzle turbocharger employing multiple pivoting vanes in the nozzle. The turbocharger incorporates a turbine housing 2 which is mounted to a turbine flange 4 using a V-band coupling 6. The turbine flange is mounted to a center housing 8 using bolts 10. A compressor back plate 12 is mounted to the center housing opposite the turbine flange using bolts 14, and a compressor housing 16 is mounted to the back plate with a V-band coupling.

The charge air compressor wheel 18 of the turbocharger is mounted to the shaft of a turbine wheel assembly 20. The shaft is supported by a bearing assembly in the center housing which, for the embodiment disclosed in the drawings, includes a pair of journal bearings 22 separated by a spacer 24 and a thrust collar 26 receiving thrust bearing 28. Appropriate lubrication channels are provided in the center housing for the bearings and shaft. A piston ring 30 provides a seal for the shaft at the turbine end while a carbon seal or equivalent labyrinth seal 32 provides a seal for the compressor end of the shaft. A seal ring 33 and seal washers 31 provide additional sealing between the center housing and compressor back plate. A disk shroud 21 is employed as a thermal baffle.

The vanes 34 of the variable nozzle are supported by axles (not shown) extending into nozzle ring 36 which, in the embodiment shown, is supported in spaced relation to the turbine housing by a plurality of spacer pins 38 and fixed by a disk spring 40. A unison ring 42 rotatably mounted on rollers 44 supported by dowel pins 46, provides the actuation for the multiple vanes. The details of the actuation and support structure for the vanes is substantially as disclosed in U.S. Pat. No. 4,804,316 previously referenced.

Figure 2:
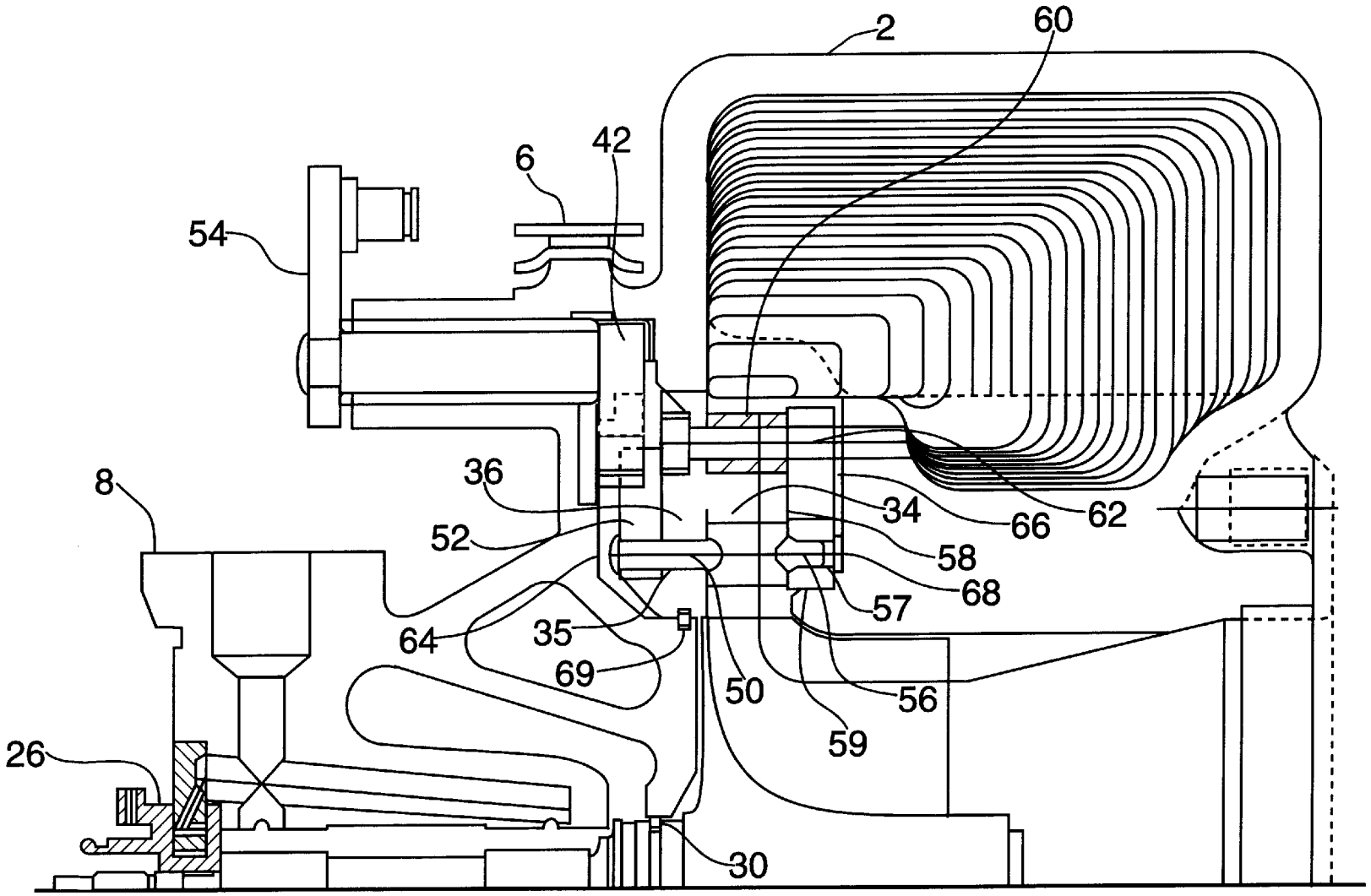
FIG. 2 is a section partial side view of an embodiment of the present invention showing the exhaust gas volute, turbine nozzle with dual axle pressure balanced vanes, and associated actuating mechanism.

The details of an embodiment of the present invention are shown in FIG. 2 wherein common components with the turbocharger of FIG. 1 are commonly numbered. Each of the vanes 34 is partially supported by a first axle 50 which extends in close relation into and is rotatably supported by apertures 35 in the nozzle ring 36. The first axle extends through the nozzle ring and is attached to a vane arm 52 which is received in slots in the unison ring 42 for actuation of the vanes. Rotation of the unison ring is accomplished by an external crank and actuator linkage 54.

A second axle 56 extends from each of the vanes, opposite and co-axial with the first axle. The second axle extends in close relation into and is rotatably supported by mating apertures 57 in an insert ring 58 which is recessed into the turbine housing and carried by a machined relief 59. The nozzle ring and insert ring form the bounding hub and shroud surfaces of the nozzle. Three precision hollow, circular spacers 60 and retaining bolts 62 are used to precisely locate and space the two rings and to secure the nozzle ring assembly to the turbine housing between the nozzle inlet and the nozzle outlet adjacent the turbine. During assembly of the turbocharger, the insert ring is free to rotate slightly to preclude any rotational mismatch of the two hole patterns in the rings.

For the double axle vane support of the present invention, as the nozzle vanes approach closure, the pressure difference across the vanes can be resolved into a force acting substantially perpendicular to the center of pressure, which is at mid-span of the vanes. Two equal reaction forces, provided by the two axles on opposite sides of the vane, counterbalance the aerodynamic loading. These reaction forces are equally balanced and the peak reaction force is reduced 66% relative to the forces present in an identical cascade of cantilevered vanes. Axle loading and wear is much more uniform than in the cantilevered design, permitting the axle diameter to be reduced and, in turn, further reduction in the frictional moment arm is achieved. The axles are located at approximately 25% of the cord length of the vanes to obtain a substantially zero aerodynamic moment on the vanes with respect to the axles.

Figure 3:
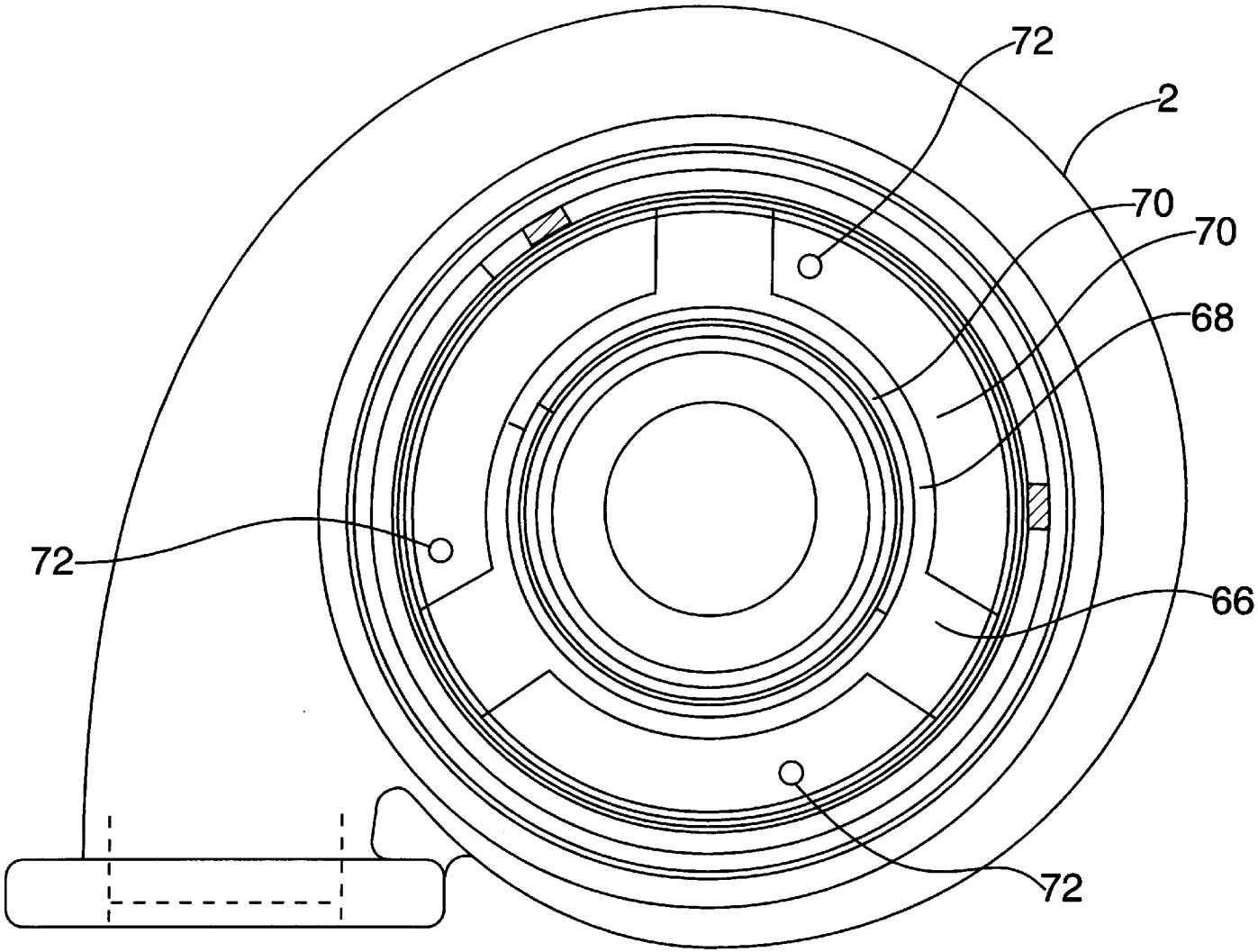
FIG. 3 is a section end view of the turbine housing showing the nozzle ring lands and gas pressure transmission channels for the axle pressure balancing in the embodiment of the invention shown.

Elimination of axial loading of the vanes is also addressed in the present invention by pressure balancing the two support axles for each of the vanes. Gas leakage from the inlet to the nozzle from the turbine volute through the various linkage and support elements associated with the nozzle ring ultimately results in a pressure in chamber 64, which acts on the end of the first axle. To balance the force created by this pressure, exhaust gas pressure from the nozzle inlet is transmitted through radial channels 66 machined into the insert ring relief in the turbine housing. An annular channel 68 extends around the relief adjacent the axle apertures in the insert ring and adjoining the radial channels to transmit the gas pressure to the head of the second axle. A seal 69 is provided between the inner circumference of nozzle ring and a mating surface on the center housing to enhance the pressure balance between the two axles. The annular and radial channels are best seen in FIG. 3 which also shows the precision machined surfaces 70 of the relief in the turbine housing which support the insert ring. Tapped holes 72 receive the bolts 62 securing the nozzle ring assembly to the turbine housing.

In alternative embodiments, the radial and or annular channels are machined into the insert ring as opposed to the turbine housing. In additional embodiments separate radial channels corresponding to and intersecting each aperture in the insert ring are machined in the insert ring or turbine housing.

Figure 4:
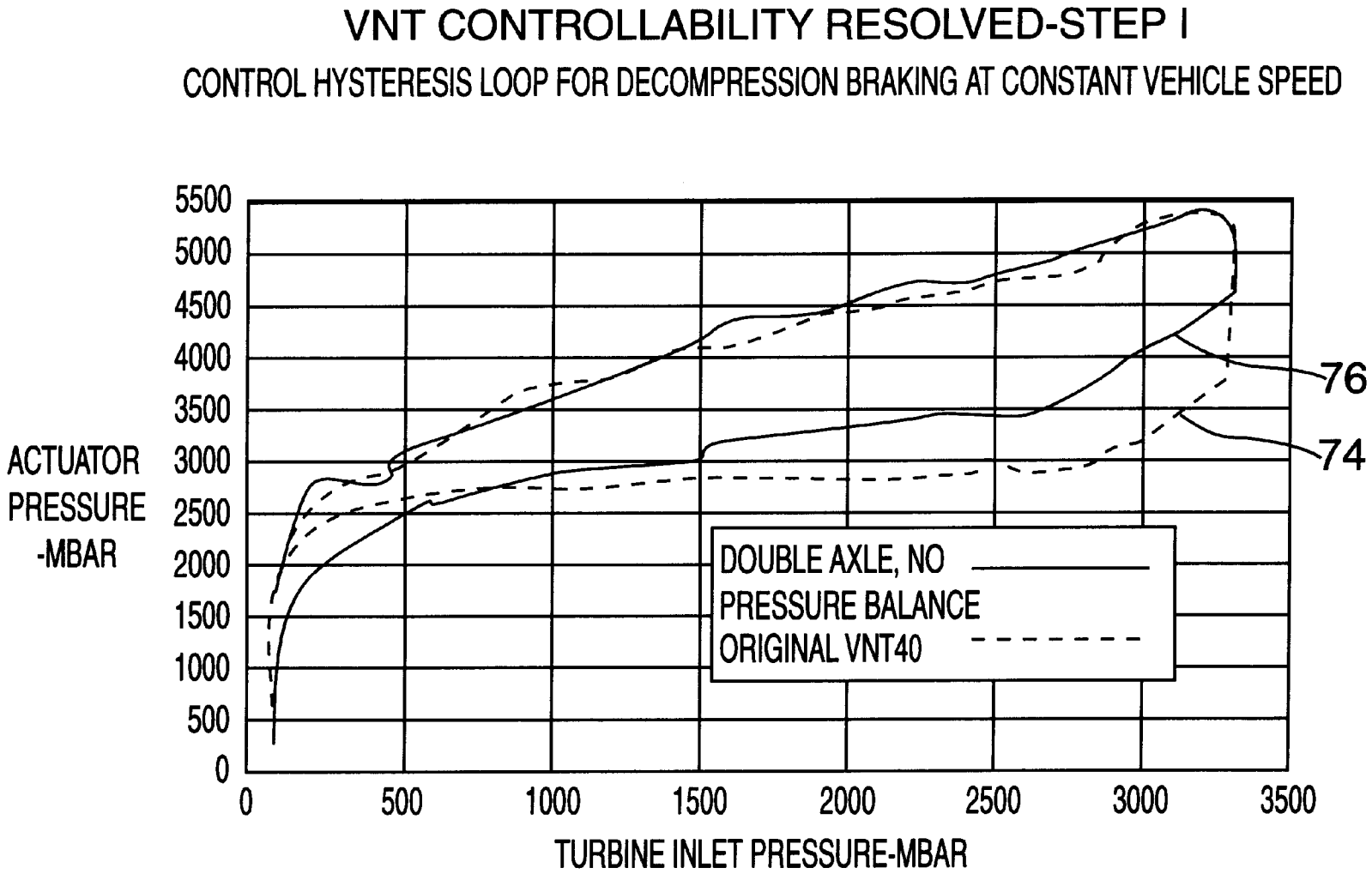
FIG. 4 is a graph of actuation hysteresis for a cantilevered vane nozzle and a comparison double axle vane nozzle.
Figure 5:
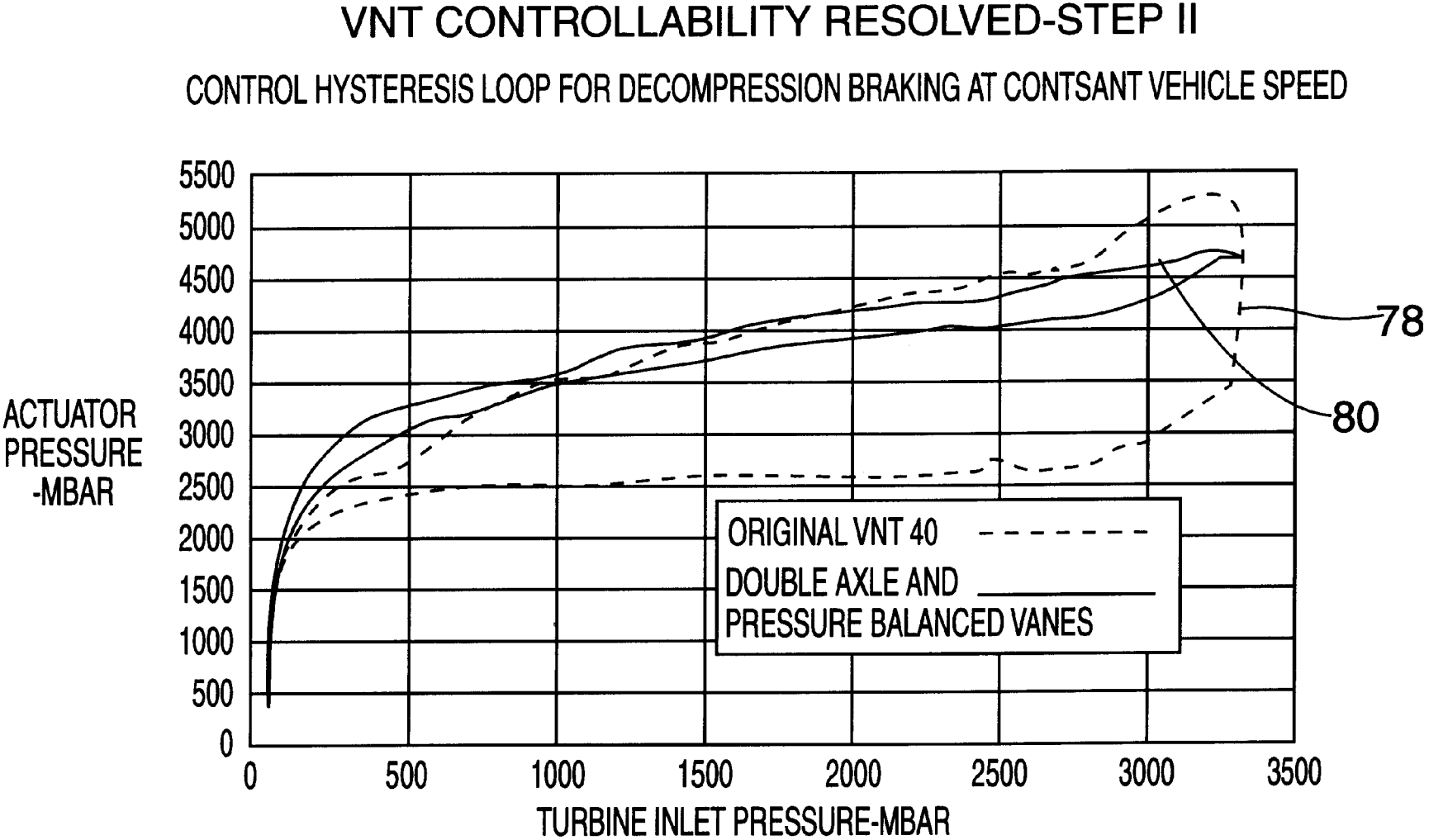
FIG. 5 is a graph of actuation hysteresis comparing the additional improvement provided by pressure balancing of the double axle vane nozzle.

The balanced pressure on the heads of the first and second axles which have equal area substantially eliminates axial loading of the vanes and any associated frictional forces impacting the control actuation of the plurality of vanes in the nozzle. FIGS. 4 and 5 are force diagrams demonstrating the hysteresis in control of the nozzle vanes. In FIG. 4 curve 74 shows the hysteresis in a conventional cantilevered vane nozzle arrangement. Curve 76 demonstrates the improvement with the double axle support for the vanes. FIG. 5 curve 78 shows the conventional cantilevered vane nozzle arrangement while curve 80 demonstrates the total improvement provided by the double axle support and pressure balancing of the present invention.

Having now described the invention in detail as required by the patent statutes, those skilled in the art will recognize modifications and substitutions to the specific embodiments disclosed herein. Such modifications and substitutions are within the scope and intent of the present invention as defined in the following claims.

What is claimed is:

1. A variable nozzle for the turbine of a turbocharger comprising:

a turbine housing having a volute receiving exhaust gas from an internal combustion engine and a nozzle inlet;

a turbine received in the turbine housing for impingement of the exhaust gas from a nozzle outlet to drive the turbine;

a plurality of vanes each having a first axle extending from one side of the vane and a second axle extending from an opposite side of the vane coaxial with the first axle;

a nozzle ring having a plurality of apertures extending through the nozzle ring and closely receiving the first axles of the plurality of vanes;

an insert ring having a plurality of apertures extending through the insert ring and closely receiving the second axles of the plurality of vanes;

means for securing the nozzle ring and insert ring in substantially rigid spaced relation to position the vanes between the nozzle inlet from the volute and nozzle outlet adjacent the turbine;

first means for transmitting exhaust gas pressure to impinge on an end of the first axle for each vane distal from the vane;

second means for transmitting exhaust gas pressure to impinge on an end of the second axle for each vane distal from the vane; and means for rotating the vanes.

2. A variable nozzle as defined in claim 1 wherein the first means for transmitting exhaust gas pressure comprises a chamber adjacent the nozzle ring distal from the vanes, said chamber having pressure communication with the nozzle inlet.

3. A variable nozzle as defined in claim 1 wherein the second means for transmitting exhaust gas pressure comprises channels extending from the nozzle inlet to the apertures in the insert ring, the channels intersecting the apertures distal the vanes proximate the end of the second axle.

4. A variable nozzle as defined in claim 2 wherein the chamber accommodates the actuation means for the vanes.

5. A variable nozzle as defined in claim 3 wherein the channels comprise at least one radial channel in the turbine housing extending between the nozzle inlet and an annular channel in the turbine housing adjacent the insert ring and intersecting the apertures in the insert ring.

6. A variable nozzle as defined in claim 4 wherein the first axles extend through the apertures in the nozzle ring and the actuation means comprises:

vane arms attached to and extending perpendicular to the first axles and received in slots in a unison ring; and a crank and linkage for rotating the unison ring.

7. A variable nozzle as defined in claim 4 wherein the chamber is disposed intermediate the turbine housing and a center housing for the turbocharger attached to the turbine housing.

8. A variable nozzle as defined in claim 7 further comprising a seal disposed between and inner circumference of the nozzle ring and a mating surface on the center housing.

9. A variable nozzle as defined in claim 1 wherein the means for securing the nozzle ring and insert ring comprises:

a plurality of rigid hollow spacers arranged intermediate the nozzle ring and insert ring; and a plurality of bolts extending through the nozzle ring, spacers and insert ring into threaded mating holes in the turbine housing.

10. A variable nozzle as defined in claim 9 wherein the insert ring is received in a machined annular recess in the turbine housing.

* * * * *